US005182825A

United States Patent [19]

Stinson et al.

[11] Patent Number: 5,182,825

[45] Date of Patent: Feb. 2, 1993

[54] WATERBED

[75] Inventors: D. Ray Stinson; Linda D. Stinson, both of 3000 N. Atlantic Ave., #4, Daytona Beach, Fla. 32118; Brian F. Roberts, Deland, Fla.; Steven J. Dahms, Ormond Beach, Fla.; Brian P. Estes, Ponce Inlet, Fla.; Tommy H. Robertson, Port Orange, Fla.

[73] Assignees: D. Ray Stinson; Linda D. Stinson, both of Daytona Beach, Fla.

[21] Appl. No.: 658,199

[22] Filed: Feb. 20, 1991

[51] Int. Cl.[5] ..... A47C 27/10

[52] U.S. Cl. ..... 5/451; 5/466; 5/625; 5/455; 5/470; 24/587

[58] Field of Search ..... 5/451, 450, 455, 82 R, 5/449, 452, 453, 456, 457, 458, 470, 466, 625, 626; 297/DIG. 3; 24/587, 576

[56] References Cited

U.S. PATENT DOCUMENTS

| | | | |
|---|---|---|---|
| 4,149,286 | 4/1979 | Fogel | 5/451 |
| 4,224,706 | 4/1980 | Young et al. | 5/455 |
| 4,234,982 | 11/1980 | Bez et al. | 5/82 R |
| 4,454,615 | 6/1984 | Whitney | 5/449 |
| 4,517,693 | 5/1985 | Viesturs | 5/451 |
| 4,737,998 | 4/1988 | Johnson, Sr. | 5/451 |
| 4,745,648 | 5/1988 | Viesturs | 5/451 |
| 4,788,730 | 12/1988 | Beaton | 5/451 |
| 4,944,060 | 7/1990 | Perry et al. | 5/453 |
| 4,972,534 | 11/1990 | Hutton | 5/450 |
| 5,007,143 | 4/1991 | Merrington | 24/587 |

FOREIGN PATENT DOCUMENTS

| | | | |
|---|---|---|---|
| 3331689 | 3/1985 | Fed. Rep. of Germany | 5/449 |
| 2435245 | 5/1980 | France | 5/451 |
| 2549366 | 1/1985 | France | 5/455 |
| 8101792 | 7/1981 | PCT Int'l Appl. | 5/455 |

OTHER PUBLICATIONS

The Ardo TM Flotation System—an Ad in the Jul. 1983 issue of Flotation Sleep industry Magazine.

Gravity TM I, A Technical Brochure Available from "Horizont International Healthcare", Inc. P.O. Box A Rahway, N.J. 07065-1175.

*Primary Examiner*—Alexander Grosz

*Attorney, Agent, or Firm*—Allen, Dyer, Doppeli, Franjola & Milbrath

[57] ABSTRACT

A waterbed having a plurality of individually water-filled bladders adjacent each other on a transfer board or other flat surface. Each bladder has a flap that attaches to the bottom surface of the adjacent bladder. The transfer board may have handles so that the waterbed may be transported. In another embodiment, foam may be placed around the bladders to give the waterbed stability. Further, the foam and bladder may be enclosed with a cover having an air-tight zippered opening. A pocket attaches to the cover that mates with the transfer board to provide stability when the waterbed is moved. A liquid-filled footrest may also be provided.

5 Claims, 3 Drawing Sheets

WATERBED

BACKGROUND OF THE INVENTION

This invention relates to an improved waterbed, method and components for constructing and using the same. More specifically, the invention relates to an improved mattress, cover and footrest for use in a waterbed.

A typical bed used in nursing homes, hospitals, and other health care facilities employs a conventional mattress and boxsprings combination. Waterbeds are an inexpensive alternative to the conventional type of health-care bed. Waterbeds typically have a flat support and a rectangular frame enclosing the sides of a water-filled bladder that rests on the support. The bladder is covered with a protective sheet, and the patient rests on the covered bladder.

A drawback to waterbeds is that certain portions of a patient's body are heavier than other portions, and when the patient rests on the waterbed, the heavier portions push down into the waterbed's bladder. Thus, the water-filled bladder must be thick enough to prevent the patient from pushing down far enough to contact the hard supporting surface below. To prevent this contact, the waterbed bladder must be thick when filled with water. Consequently, the waterbed becomes heavy making it difficult to move the bed without draining the bladder. If the patient must be moved, the patient must be lifted off the bed and put on a movable bed, or transport cart.

Another drawback to the use of waterbeds in health-care facilities is that dust or other particles may fall into the crevices between the bladder and the frame. Consequently, it is difficult to keep waterbeds clean and sterile.

SUMMARY OF THE INVENTION

An Object of this invention is to provide an improved waterbed construction and method for making, which is particularly suited for use in health-care facilities.

Another object of the invention is to provide a waterbed having individually separable bladders that are easily removable from the waterbed.

A further object of the invention is to improve a waterbed cover that encloses waterbed bladder.

Another object of this invention is to improve the method of transporting a watered in a health-care facility.

It is also an object of this invention to cover a waterbed using an improved zipper to seal a waterbed bladder within the cover.

An additional object of the invention is to improve a footrest for use on a waterbed.

It is another object of this invention to provide a waterbed that fits on a sliding transfer board that can be easily transported without the pieces on the board falling off.

To achieve these objects a waterbed is provided comprising a plurality of removable bladders resting on a supporting surface and adapted for holding water, each bladder having means for physically attaching itself to an adjacent bladder so that the bladders remain attached when moved with a transport board.

In a preferred form, a waterbed adapted to be supported on a transportable board includes a bladder adapted to be filled with water and constructed from a flexible material, the bladder being enclosed with a liner having a pocket that is adapted to mate with the transfer board such that when the bladder is transported on the transfer board, the liner remains attached to the board to constrain the bladder.

In an alternate form, the waterbed comprises a bladder adapted for holding water and supporting a person in a horizontal position, means for completely covering the bladder having an opening bordering by the edges of the covering means wherein the bladder may be inserted and removed from the cover means through the openings, and means for drawing the edges of the covering means together to close the opening, thereby providing an airtight seal around the bladder. By sealing the bladder air-tight, the person supported on the waterbed is prevented from becoming wet if the bladder were to leak.

In another alternate form the waterbed includes a first bladder adapted for holding water and for supporting a person, and means for supporting said bladder when the person is supported on the bladder. The waterbed also includes a cover means for enclosing the bladder and a second cover means enclosing the first cover for reducing shearing of the skin of the person when the person is supported on the waterbed.

In an alternate form, the waterbed for use in a health-care facility is provided comprising a first bladder adapted for holding water and for supporting a person, a foam inlay disposed about the periphery of the bladder and a cover enclosing the foam inlay and the bladder air-tight. The waterbed further comprises a transfer board disposed below and supporting the cover, bladder and foam inlay, and a plurality of handles on the transfer board for transporting the waterbed.

Further, to achieve these above objects, the invention includes a method of elevating the foot of a person lying in a horizontal position on the bed comprises the steps of filling a substantially cylindrically-shaped container constructed from a flexible plastic material with water, and placing the water-filled cylindrically-shaped container on the foot of the bed, such that when a person lies on the bed, the feet of the person rests on the container and are elevated.

In the preferred form, the method of constructing a waterbed is provided comprising the steps of providing a transport board having a plurality of handles disposed thereon, providing a water-filled bladder, and resting the bladder on the transfer board such that the bladder may be transported by moving the transfer board using the handles. The method may further comprise the step of enclosing the bladder with a liner, and covering a portion of the transport board with a pocket disposed on the liner, such that the waterbed is constrained on the transport board while the transport board is being moved.

DESCRIPTION OF THE PREFERRED EMBODIMENTS

Figure 1:
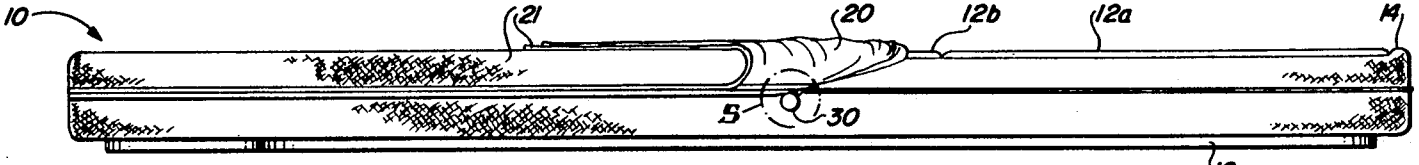
FIG. 1 is a side view of the waterbed having a multiplicity of bladders and a foam inlay, resting on a transfer board.
Figure 2:
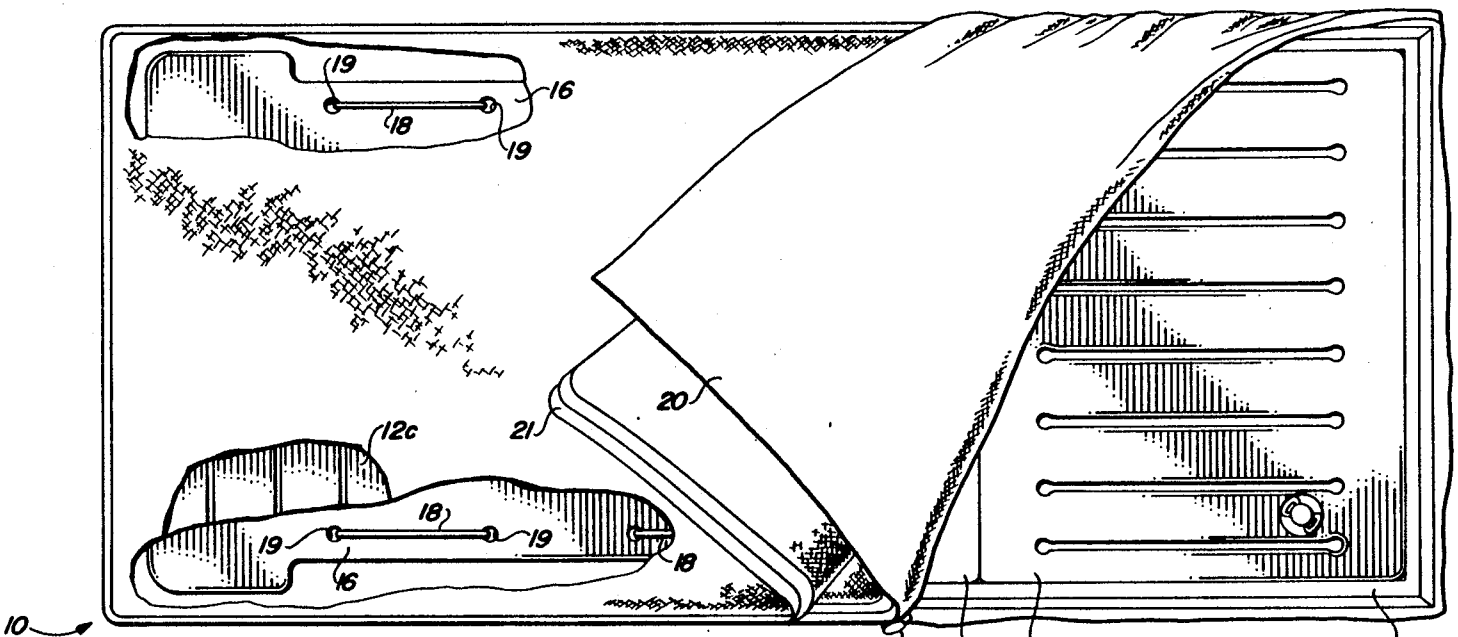
FIG. 2 is a top view of the waterbed.

Referring to FIGS. 1-4, there is shown a waterbed 10 having a plurality of water-filled vinyl bladders 12(*a–c*) held in place with surrounding foam inlay 14. Bladders 12(*a–c*) each preferably have dimensions of 23-27 inches long by 34 inches wide by 4 inches deep when full and contain baffles or partitions to reduce wave action. Referring to FIGS. 1 and 2, bladders 12(*a–c*) and foam inlay 14 rest on transfer board 16 having handles 18 for holding waterbed 10 during transport. Bladders 12(*a–c*) and foam inlay 14 are enclosed with a plastic safety sealed cover 20 and durable cover 21.

Figure 3:
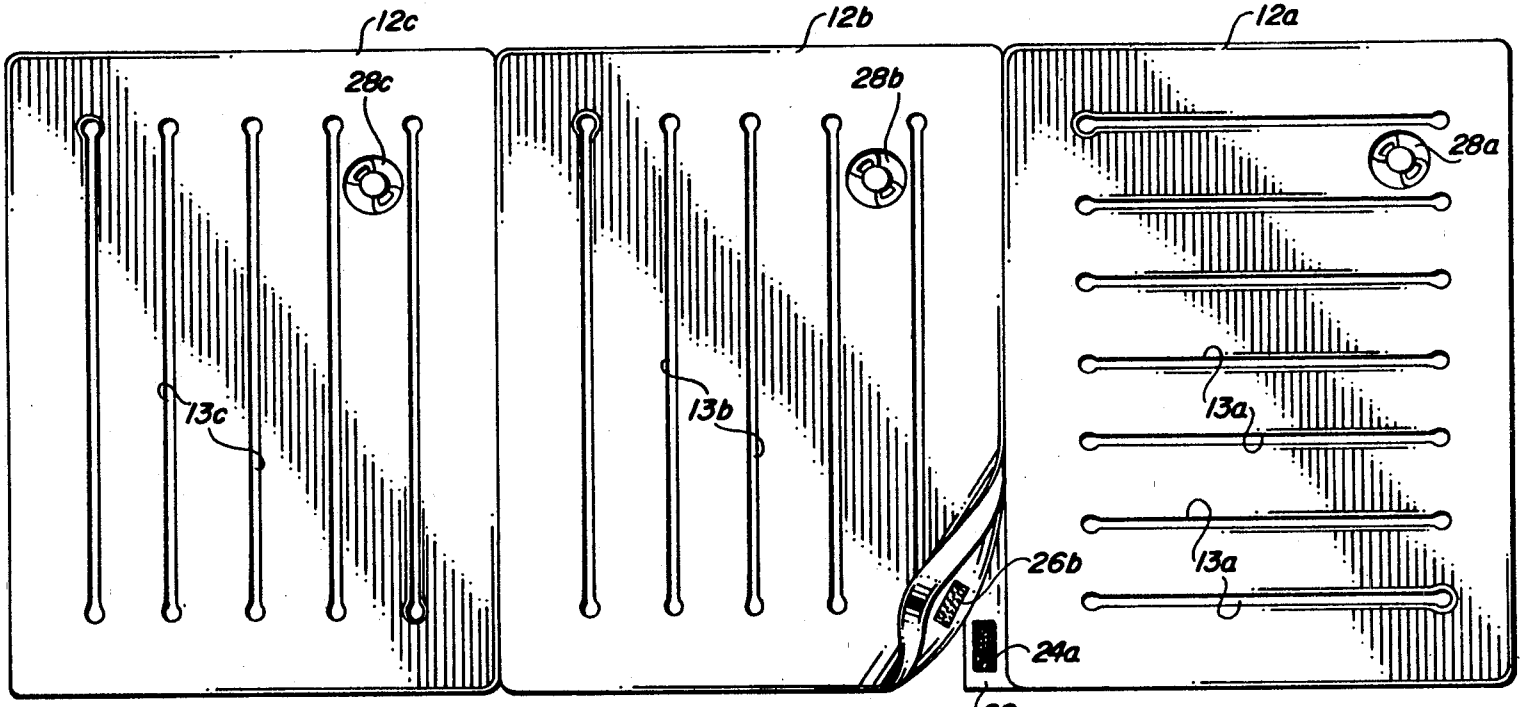
FIG. 3 is a top view of the bladders that rest on the transfer board shown in FIG. 1.
Figure 4:
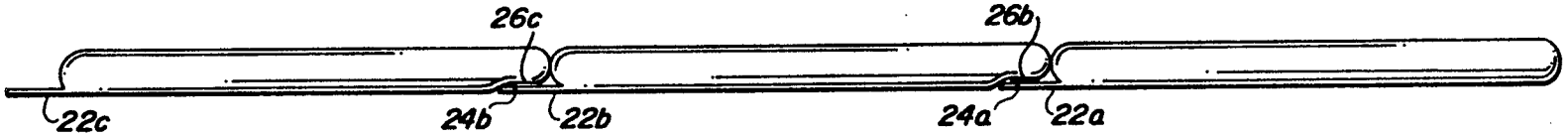
FIG. 4 is a side view of the waterbed shown in FIG. 3.

Referring to FIGS. 3 and 4, bladders 12(*a–c*) each contain a flap 22(*a–c*). respectively. Flaps 22(*a–b*) have hook-and-loop fastener strips 24*a* and 24*b* (FIG. 4) that removably attach to mating hook-and-loop fastener strips 26*b* and 26*c* (FIG. 4) located on the bottom of bladders 12(*b–c*). Referring to FIG. 3, bladders 12(*a–c*) have a removable plug 28(*a–c*) through which water enters and is drained It is recognized that bladders 12(*a–c*) may be removably attached to each other to allow ease in transport and storage without draining as each bladder, when full, weighs 120–150 pounds.

Referring to FIGS. 1 and 3, each bladder 12(*a–c*) contains a multiplicity of baffles 13(*a–c*). The baffles 13(*a–c*) join the top surface of bladders 12(*a–c*) with their bottom surface. Baffles 13(*a–c*) provide a barrier within bladder 12(*a–c*) such that when the bladders containing water are depressed, wave action is suppressed. The baffles 13*a* in bladder 12*a* are disposed in a longitudinal orientation on waterbed 10 and baffles 13*b* and 13*c* are disposed in a lateral orientation. Bladders 12(*a–c*) are preferably formed using a lap seam sealing technique whereby one edge of the bladder is folded and another edge of the bladder is inserted into the folded edge and sealed. This lap seam provides better durability and less resistance to leakage than conventional seam sealing techniques.

Referring to FIG. 1 and FIG. 2, foam inlay 14 is preferably constructed with a foam material such as polysol and polyisoyonate, however, any material that provides support for bladders 12(*a–c*) can be used. Foam inlay 14 preferably has an outer dimension of 80 inches long by 35 inches wide and 3-5 inches high.

Transfer board 16 is preferably made from a rigid material such as wood and has handles 18 constructed from nylon. Handles 18 insert into holes 19 drilled into transfer board 16 in two parallel rows adjacent the edge of transfer board 16. Each row of handles 18 are inserted in holes 19. Handles 18 are preferably six inches long and are spaced 10 inches apart. Although handles 18 shown are inserted into transfer board 16, transfer board 16 may be easily modified to eliminate nylon handles and have handles cut out of transfer board 16.

Figure 5:
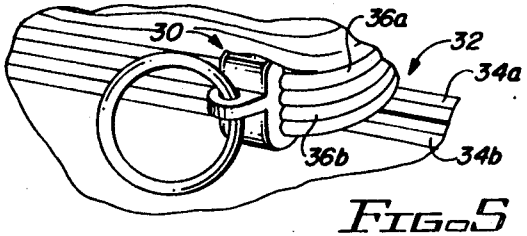
FIG. 5 is a side view of the zipper on the waterbed of FIG. 1.

Sealed cover 20 is preferably constructed from a flexible plastic material, such as vinyl and has a zipper 30. Referring to FIGS. 1, 2 and 5, zipper 30 may be opened to allow bladders 12(*a–c*) and foam inlay 14 to be inserted and removed from within sealed cover 20. Sealed cover 20 has an opening 32 and two parallel sets of ridges 34(*a–b*) and 36(*a–b*). Ridges 34(*a–b*) engage with ridges 36(*a–b*) when zipper 30 slides to provide a double seal along opening 32. When zipper 30 is slid shut, foam inlay 14 and bladders 12(*a–c*) are sealed airtight within sealed cover 20.

Enclosing sealed cover 20 is durable cover 21, preferably constructed from Dura Blue material available from American Health Systems of Greenview, S.C. Durable cover 21 insulates the patient on waterbed 10 from sealed cover 20. Durable cover 21 provides an outer enclosure to permit ease in cleanup by being easy to remove from sealed cover 20. Durable cover 21 also reduces shearing of the skin of a patient resting on waterbed 10.

Figure 6:
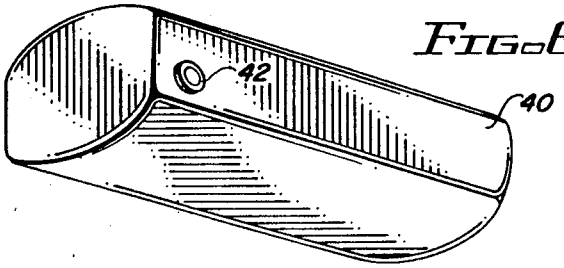
FIG. 6 is a plan view of the footrest for the waterbed.

Referring to FIG. 6, there is shown a water-filled footrest 40 which is constructed from a plastic material and is cylindrically shaped. Footrest 40 has a removable plug 42 to allow water to be filled and drained. It is preferable that footrest 40 only be partially filled with water to provide a softer cushion. Footrest 40 during use may be placed under the foot of a person resting on waterbed 10 or of any bed.

Figure 7:
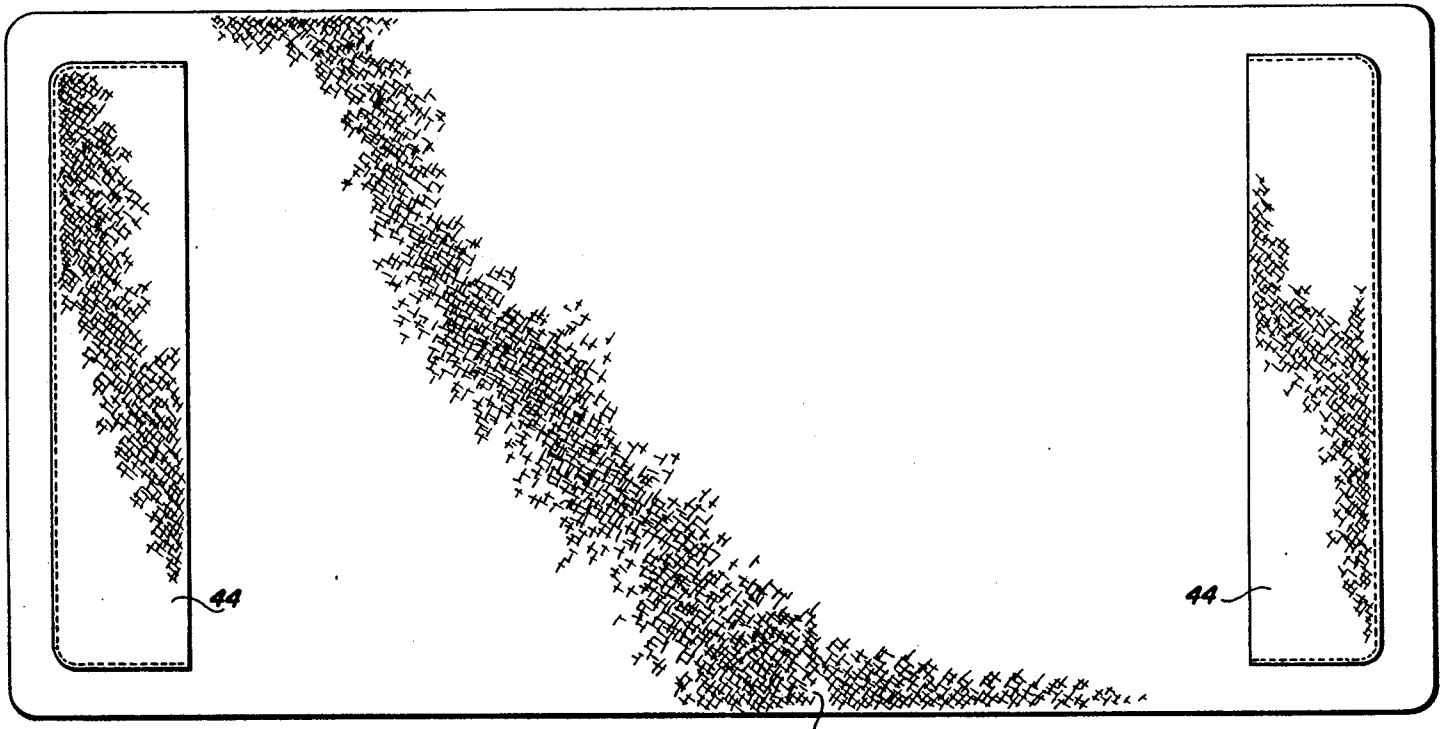
FIG. 7 is a bottom view of the waterbed cover having pockets that mate with the transfer board shown in FIG. 1.

Referring to FIG. 7, there are shown pockets 44 fastened to the bottom surface of sealed cover 20. Pockets 44 are located adjacent the ends of sealed cover 20 and are adapted to mate with the end portion of transfer board 16. Pockets 44 constrain cover sealed 20 to transfer board 16 to allow ease in transporting waterbed 10. Pockets 44 preferably have a width of 11 inches and a length of 32 inches.

This concludes the description of the preferred embodiments. A reading by those skilled in the art will bring to mind various changes without departing from the spirit and scope of the invention. It is intended, however, that the invention only be limited by the following appended claims.

What is claimed is:

1. A bed for use in a health-care facility comprising:

a bladder adapted for holding fluid and for supporting a person;

a foam inlay disposed about the periphery of the bladder;

a cover enclosing the foam inlay and the bladder;

a transfer board supporting the cover, the foam inlay and the bladder;

means coupled to the cover for removably securing said bladder to said transfer board;

a plurality of handles on said transfer board for use in transporting the bed; and a zipper for opening the cover to remove the foam inlay and the bladder.

2. The waterbed as recited in claim 1 further comprising a second bladder, and means for removably mating said first bladder with said second bladder within the cover.

3. The bed of claim 1, including a further cover means, enclosing the cover means, for reducing shearing of skin of a user of the bed.

4. The bed of claim 1, wherein the means coupled to the cover comprises pockets sealed adjacent the ends of the cover.

5. The bed of claim 1, wherein the bladder contains a plurality of baffles that join the top and bottom surface of the bladder.

* * * * *